US006227218B1

(12) United States Patent
Breaux

(10) Patent No.: US 6,227,218 B1
(45) Date of Patent: May 8, 2001

(54) TENT POLE CLIP

(75) Inventor: Terry J. Breaux, Seattle, WA (US)

(73) Assignee: Mountain Safety Research, Inc., Seattle, WA (US)

( * ) Notice: Subject to any disclaimer, the term of this patent is extended or adjusted under 35 U.S.C. 154(b) by 0 days.

(21) Appl. No.: 09/361,696

(22) Filed: Jul. 27, 1999

(51) Int. Cl.[7] ..... E04H 15/00
(52) U.S. Cl. ..... 135/120.1
(58) Field of Search ..... 135/120.1, 120.3, 135/119; 52/719; 403/398, 396, 400

(56) References Cited

U.S. PATENT DOCUMENTS

| | | | | |
|---|---|---|---|---|
| D. 252,976 | | 9/1979 | Hanson et al. . | |
| 2,520,998 | | 9/1950 | Cella . | |
| 2,523,785 | | 9/1950 | Sereno . | |
| 3,223,098 | * | 12/1965 | Dole, Jr. . | |
| 3,903,574 | | 9/1975 | Fraioli . | |
| 4,193,413 | * | 3/1980 | Watts et al. | 135/2 |
| 4,265,260 | | 5/1981 | Gillis . | |
| 4,414,993 | | 11/1983 | Gillis . | |
| 4,440,519 | | 4/1984 | Pennel et al. . | |
| 4,827,958 | * | 5/1989 | Cantwell et al. | 135/104 |
| 4,877,044 | * | 10/1989 | Cantwell et al. | 135/120.3 |
| 5,197,504 | * | 3/1993 | Howe | 135/102 |
| 5,901,727 | * | 5/1999 | Kramer et al. | 135/120.1 |
| 6,094,801 | * | 8/2000 | Howe | 135/119 |

* cited by examiner

*Primary Examiner*—Alvin Chin-Shue
*Assistant Examiner*—Sarah Purol
(74) *Attorney, Agent, or Firm*—Christiansen O'Connor Johnson Kindness PLLC

(57) ABSTRACT

A tent (10) includes a fabric shell (12) supported by a plurality of poles (16). The poles (16) are selectively secured to the fabric shell (12) by a plurality of clips (20). Each clip (20) includes a base (26) that is directly sewn or otherwise secured to the fabric shell (12). Each clip further defines a clasp portion (24) that selectively receives a first pole (16*a*), and which may also selectively receives a transverse second pole (16*b*). A width defined by the base (26) is preferably wider than a width defined by the clasp portion (24) for enhanced stability.

20 Claims, 5 Drawing Sheets

TENT POLE CLIP

FIELD OF THE INVENTION

The present invention relates to fabric shelters, and specifically to tent structures supported by poles.

BACKGROUND OF THE INVENTION

Outdoor recreation such as camping, hiking, back-country skiing, climbing and the like often requires, or is made more enjoyable by, the use of a portable fabric shelter. Tents have been enjoyed for years for this purpose, typically consisting of a flexible folding fabric shell that is supported by rigid or semi-rigid poles to form a shelter. Tents may be large for activities such as camping, or may be small, compact and lightweight for activities such as hiking and climbing. It is desirable for the tent fabric shell to be securely, but quickly and readily, assembled to the supporting pole structure. Similar considerations apply to smaller shelters such as bivouac-sacks, as well as canopies and "flying wing" shelters.

One manner of assembling poles to tent fabric is to slide the poles through fabric tubes or sleeves formed on the tent. While securely attaching the fabric to the poles, this method of assembly is time-consuming and cumbersome. Thus, many tents today include a plurality of clips that are attached to the tent fabric along the seams. The clips are then secured to the supporting poles. In particular for freestanding tents, a tent pole will typically have a first end received by a grommet or seat extending from the tent fabric close to the ground on one side of the tent. The tent pole then reaches up and bends over the tent, with the opposing end being received in a corresponding grommet or seat defined on the opposite side of the tent. Between the ends, a plurality of clips secured to the tent fabric are connected to the pole.

Conventional clips are formed of either metal or a substantially rigid plastic, such as Nylon polyamide. The clips are tethered to the tent fabric by a short length of fabric webbing, such as Nylon, or by an elastic cord. During and after assembly, the fabric or elastic cord tether allows the clip to be pulled relative to the fabric, and to pivot relative to the fabric. This results in a tent pole support structure that can be rather shaky and unstable. Further, many tents utilize a plurality of poles which cross each other at certain points. In conventional tent designs, at the point of crossing the poles are not secured together. Thus, they freely slide relative to each other in all directions. This again tends to contribute towards the general instability of the tent.

SUMMARY OF THE INVENTION

The present invention provides a fabric shelter, such as a tent, canopy or bivouac-sack, which includes a fabric shell and at least a first pole for supporting the fabric shell. The shelter includes at least one clip that defines a clasp portion for selective attachment to the first pole, and a base secured to the fabric shell. The clasp portion defines a clasp length oriented along an axis of the first pole, and the base defines a base length oriented parallel to the axis of the first pole. The base length is longer than the clasp length. This provides a stable securement of the clip to the fabric, and prevents the pivoting of the clip relative to the fabric.

In a further aspect of the present invention, the base of the clip is sewn or otherwise secured directly to the fabric shell, without any intervening tether, thereby further stabilizing the position of the clip relative to the fabric shell and the poles secured thereby.

In a further aspect of the present invention, a fabric shelter is provided that includes a fabric shell and at least a first pole for supporting the fabric shell. A clip is secured to the fabric shell, and defines a clasp portion for selective attachment to the first pole. The fabric shelter further includes a second pole, and the clip defines an aperture into which the second pole is slidably received to secure the second pole to the clip generally transverse with respect to the first pole.

The present invention thus provides for a highly stable tent or other fabric shelter. A single clip suitably accommodates crossed poles, and the clip has a broad base preferably sewn directly to the tent fabric. This maintains the positioning of the poles with regard to each other, and maintains the fabric shell in stable position with respect to the clip and poles.

In a further aspect of the present invention, a tent clip having the foregoing features is provided for securement to the fabric of a tent.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
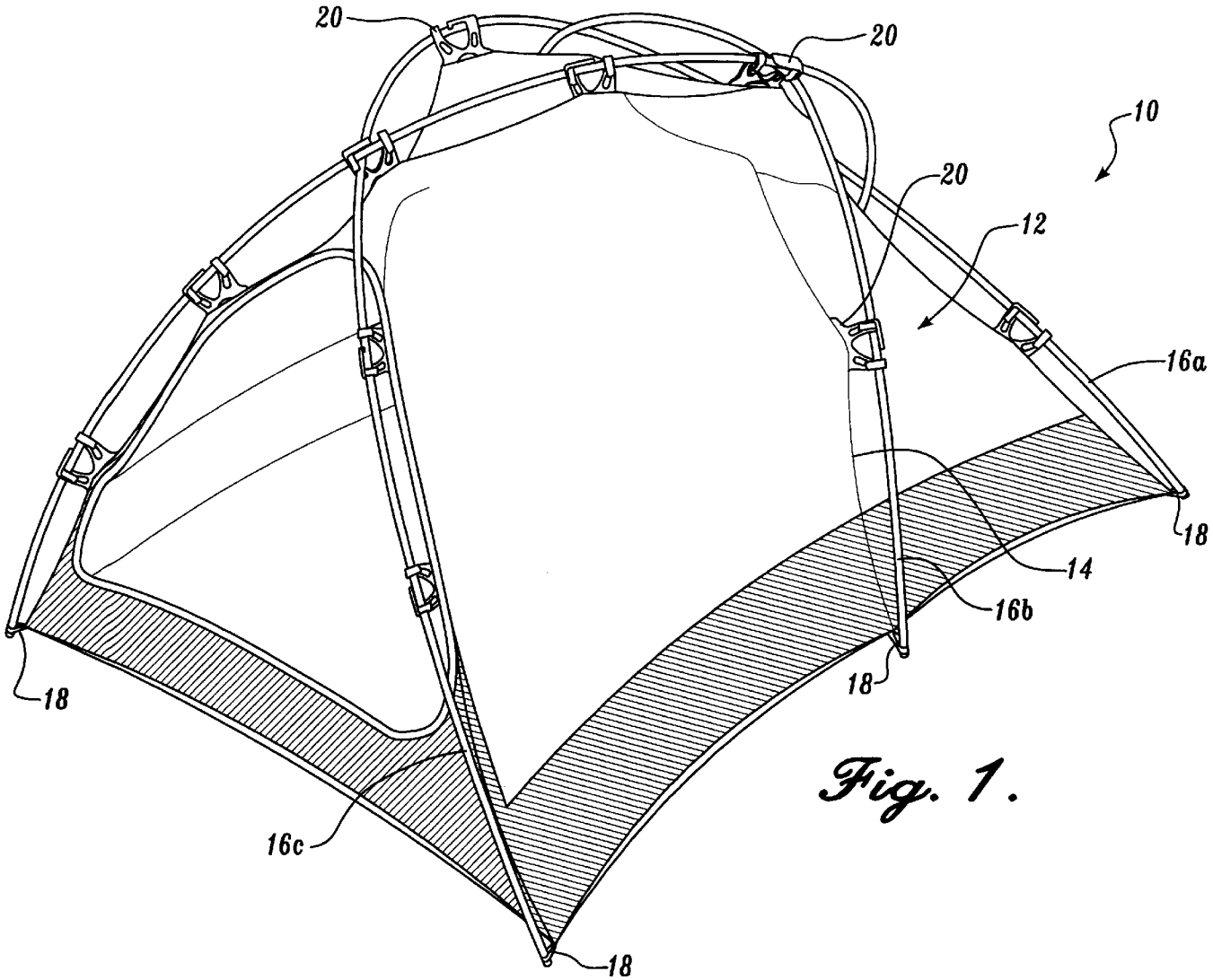
FIG. 1 provides a pictorial view of a preferred embodiment of a tent constructed in accordance with the present invention.

A preferred embodiment of a tent 10 constructed in accordance with the present invention is illustrated in FIG. 1. While a tent is illustrated, the present invention should also be understood to be readily adapted for use with other portable fabric structures, such as bivouac sacks, canopies and flying wing shelters. The tent 10 includes a body formed from a fabric shell 12 defining sides and a floor. The fabric shell 12 is formed from sheets of cloth material, such as woven nylon or other thin flexible material, preferably joined together by sewing, or alternately by other methods such as heat sealing or adhesive, to define seams 14. The fabric shell 12 is supported in an upright position by a plurality of poles 16. In the preferred embodiment illustrated, three poles 16*a*, 16*b* and 16*c* are utilized. The exact number and arrangement of the poles may vary with numerous other known arrangements of tents. The opposing ends of the poles 16 are secured to the fabric shell 12 along the floor of the tent within corresponding fasteners 18. Along their lengths, each of the poles 16 is detachably secured to the fabric shell 12 by a plurality of tent pole clips 20.

Figure 2:
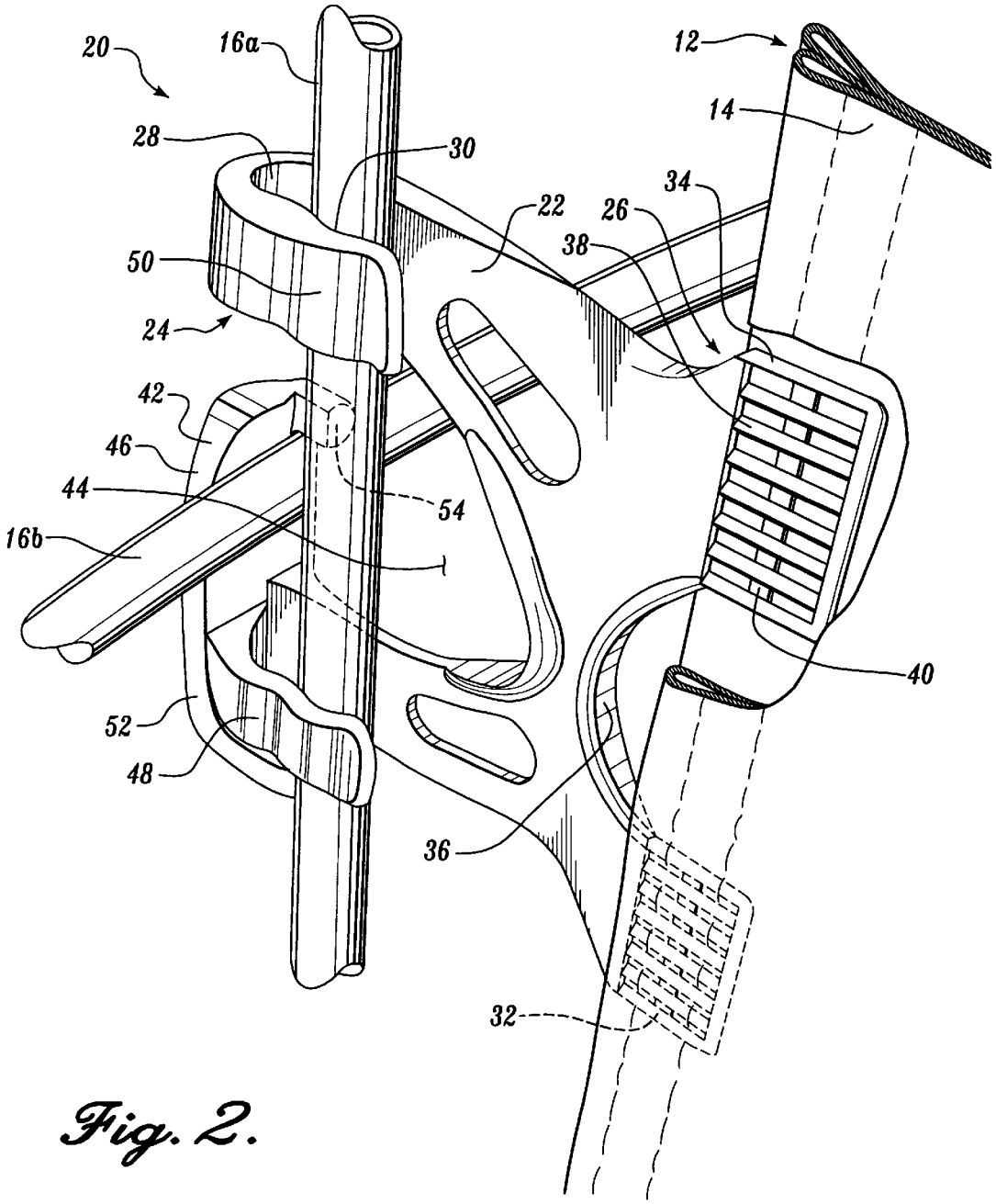
FIG. 2 provides a pictorial view of a tent pole clip constructed in accordance with the present invention and sewn into the seam of the tent fabric, a portion of the fabric being removed for clarity, with a first tent pole being received in a lower seat of the clasp portion and a second tent pole being received transversely thereto.

Attention is now directed to FIG. 2 to illustrate the construction of the clips 20 and securement of the same to the fabric shell 12. Each clip 20 includes a generally flat primary wall 22. A bifurcated clasp portion 24 extends from an upper end of the wall 22, as viewed from the left side of FIG. 2. A base 26 extends from the opposite, lower end of the wall 22. The terms "upper" and "lower" are used herein to refer to directions defined by the clasp portion and base ends, respectively, of the clip 20. However, it should be understood that the clip 20 can be arranged in any orientation.

The wall 22 of the clip 20 defines a primary plane. The base 26 extends within the primary plane. The clasp portion 24 is defined by the upper end of the wall 22 folding arcuately over upon itself, such that the clasp portion 24 defines a second plane oriented generally parallel to the primary plane and spaced therefrom. A first pole 16*a* (for purposes of example) is detachably and selectively received between the clasp portion 24 and wall 22.

Figure 3:
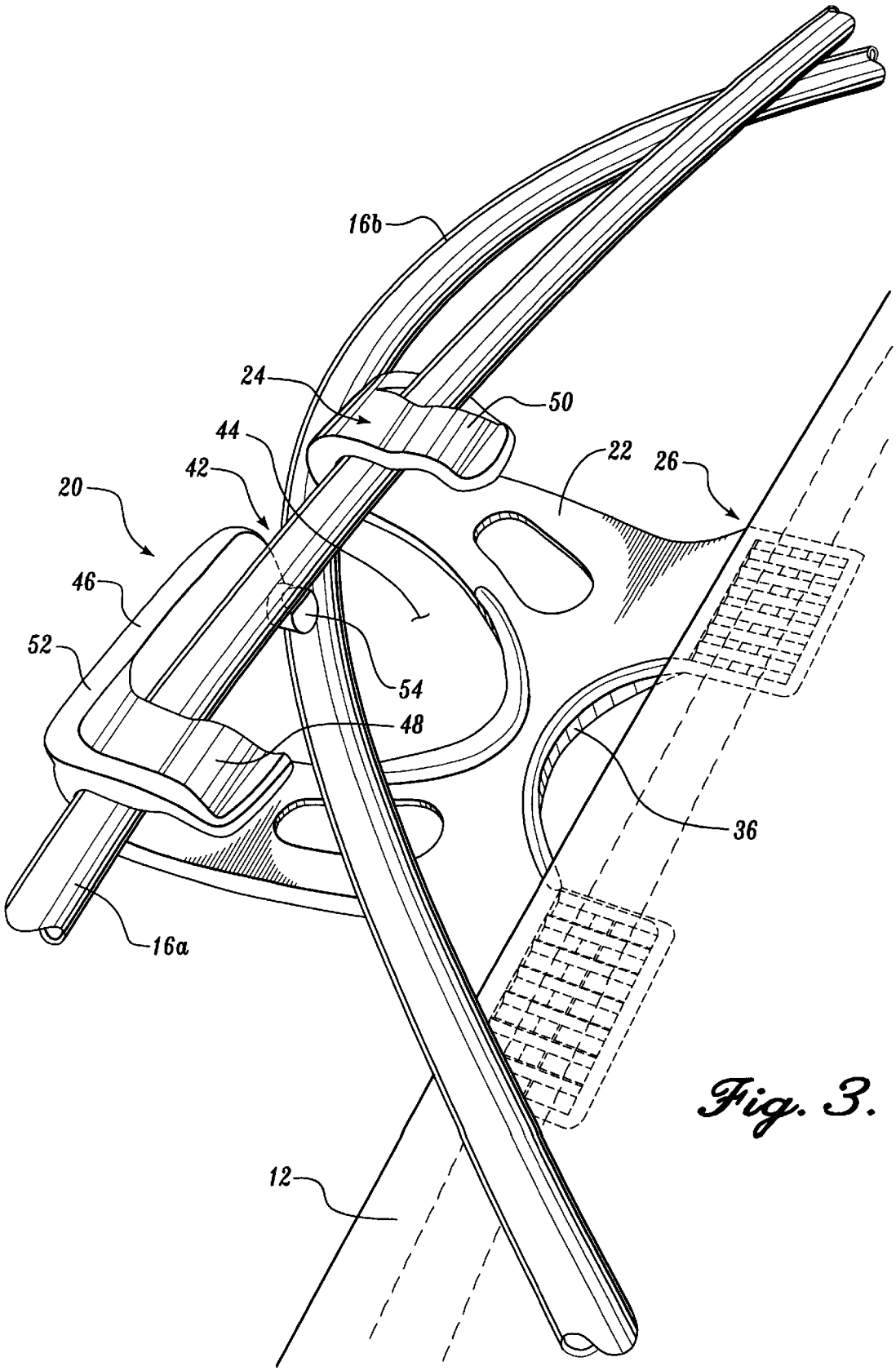
FIG. 3 provides a pictorial view of the tent pole clip of FIG. 2, with the first pole secured in an upper seat of the clasp portion and the second pole received generally transversely with respect thereto.
Figure 5:
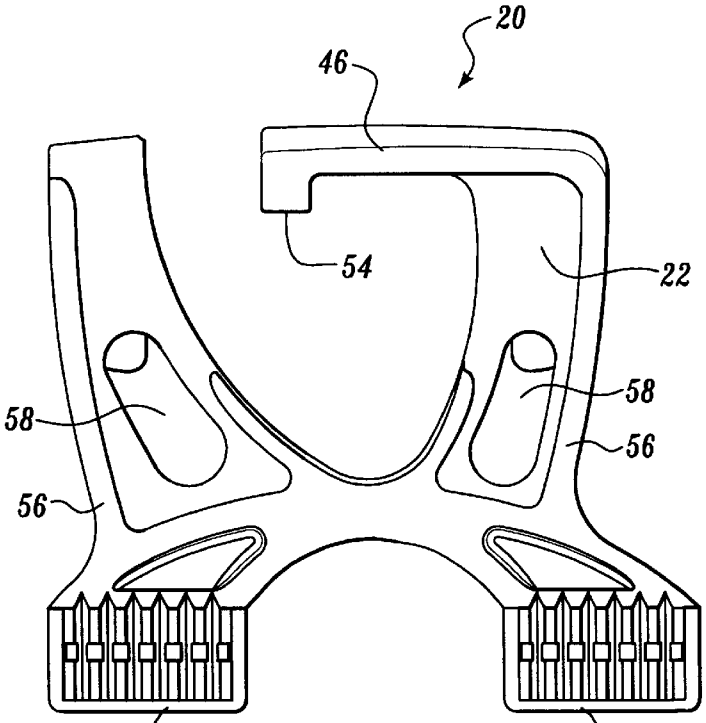
FIGS. 4–8 provide front plan, rear plan, side, top and bottom views of the tent pole clip of FIG. 2.
Figure 4:
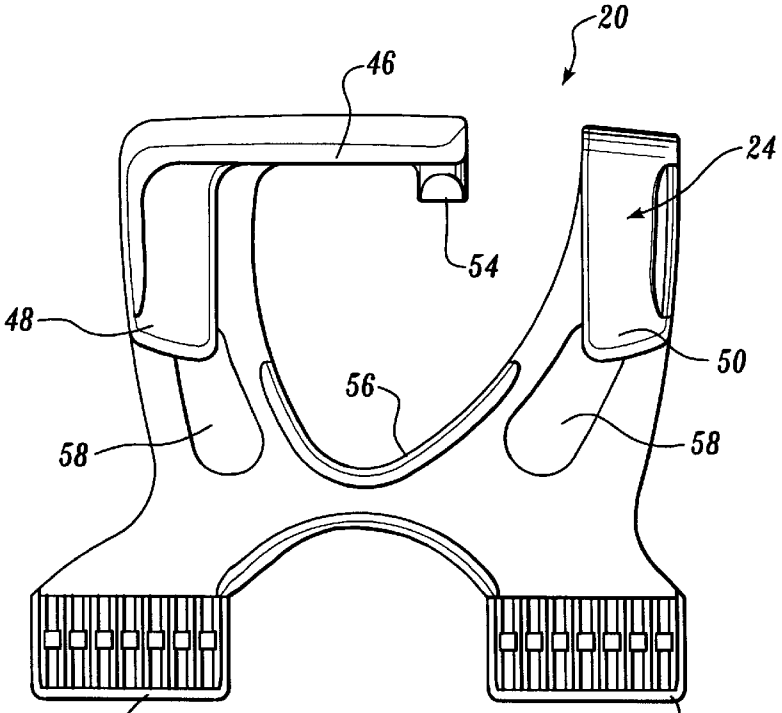
Figure 6:
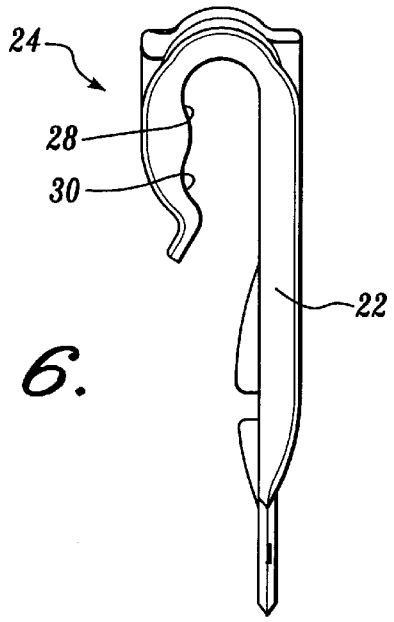
Figure 7:
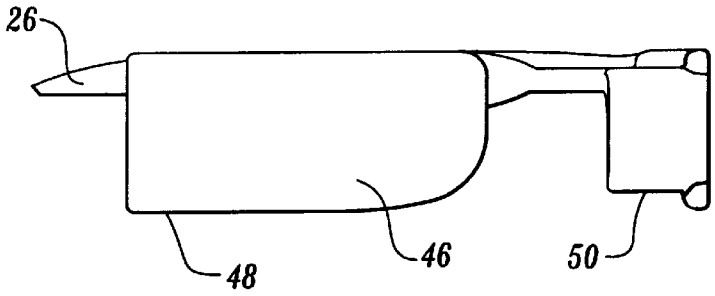
Figure 8:
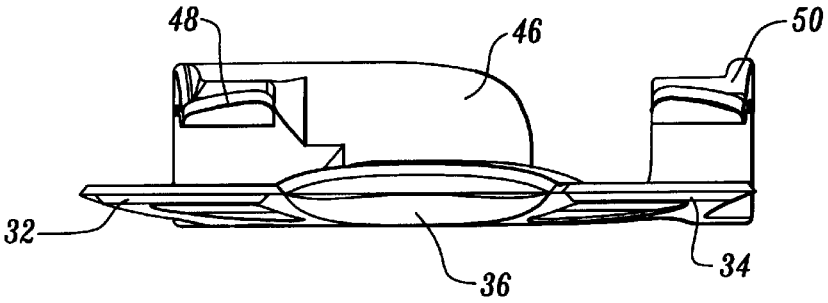

The clip 20 is perfectly formed from a substantially rigid resilient material, such as a thermoplastic polymer or a fiber-reinforced thermosetting polymer. One suitable material is Nylon polyamide. Other materials such as spring steel can alternately be utilized. When the first pole 16*a* is inserted into the gap between the clasp portion 24 and the wall 22, the clasp portion 24 is spread slightly from the wall 22, exerting a resilient biasing force on the first pole 16*a* to firmly secure the first pole in place. Preferably, the interior surface of the clasp portion 24 defines an elongate semi-cylindrical upper seat 28, defined at the arcuate junction between the clasp portion 24 and the wall 22. A second elongate semi-cylindrical lower seat 30 is defined adjacent and parallel to the upper seat 28. Rather than semi-cylindrical seats, a grove or other seat can be formed. When the first pole 16*a* is received in the upper seat 28, as illustrated in FIG. 3, it is positioned at the arcuate junction of the clasp portion 24 and the wall 22. When the first pole 16*a* is received in the lower seat 30, as illustrated in FIG. 2, it is positioned adjacent the lower edge of the bifurcated clasp portion 24, towards the base 26. The lower-most edge of the clasp portion 24 is flared outwardly away from the wall 22, to ease insertion of the first pole 16*a* into the clip 20.

The first pole 16*a* defines a first longitudinal axis. The upper and lower seats 28, 30 each define an axis that is parallel to the first longitudinal axis. The width of the bifurcated clasp portion 24 of the clip 20, as measured along the axes of the seats 28, 38 defines a clasp width. The base 26 defines a base width measured along a line parallel to and offset from the first longitudinal axis. The base width is preferable at least as long as, and still more preferably is longer than, the clasp width. Most preferable the base width is at least 15% longer than the clasp width. This provides a broad stable line of attachment of the clip 20 to the fabric shell 12, reducing pivoting of the clip 20 relative to the fabric shell 12.

Referring to FIG. 1, when assembled, each clip 20 extends generally perpendicularly from a plane defined tangentially to the immediate portion of the fabric shell 12 to which the clip 20 is secured. The direct securement of the base 26 of each clip 20 to the fabric shell 12, and the breadth of the base 26, makes this a stable mounting. The clip 20 remains substantially orthogonal relative to the immediate surrounding portion of the fabric shell 12.

Referring to FIG. 2, the base 26 of the clip 20 may suitably extend continuously across its width. However, in the preferred embodiment illustrated, the base 26 is bifurcated into two base tabs 32 and 34, separated by a recess 36. A lip for strength borders the recess 36. The substantially rigid resilient material forming the clip 20 is formed into a mesh across each of the tabs 32 and 34 of the base 26. Specifically, each tab 32, 34 defines a plurality of downwardly extending struts 38 and crosswise reinforcing braces 40. This mesh provides a plurality of apertures, through which the stitching can readily pass during sewing of the base 26 to the fabric shell 12, without significant weakening of the base 26. The vertical struts 38 of the base tabs 32 and 34 simply deflect side to side as the sewing needle passes therethrough. The clip 20 is preferably formed as a unitary, one-piece molding. Alternately, the clip 20 can be formed from a bent sheet of substantially rigid material, or can be assembled from components.

While it is preferred that the clip 20 be sewn to the fabric shell 12 as illustrated in FIG. 2, other means of direct securement of the clip 20 to the fabric shell 12 can be utilized, such as adhesive bonding or thermo-welding.

Attention is now directed to FIGS. 2 and 3 to illustrate a further aspect of the present invention. The first pole 16*a* is selectively received between the clasp portion 28 and wall 22. A second pole 16*b* may additionally be secured within the clip 20, generally transversely to the first pole 16*a*. For this purpose, the wall 22 and clasp portion 24 are partially bifurcated by a slot 42. The slot 42 extends into the folded-over portion of the wall 22 that defines the clasp portion 24.

After passing through the upper junction of the wall 22 and clasp portion 24, the slot 42 expands into an enlarged aperture 44. A shelf 46 is defined partially over the aperture 44 by the juncture between the clasp portion 24 and the wall 22. As viewed in FIG. 3, the shelf 46 extends from the left side of the clasp portion 24 towards the right side, approximately ⅔ of the way across the width of the aperture 40. A segment of the clasp portion 24 of the clip 20 beneath the shelf 46 is absent, such that the bifurcated clasp portion 24 defines two longitudinally spaced fingers 48 and 50. It is the interior of these fingers 48 and 50 that define the upper and lower seats 28 and 30. Both fingers 48 grasp the first pole 16*a* and 50 when the first pole 16*a* is received between the clasp portion 24 and the wall 22. The left finger 48 and the shelf 46 are reinforced by a lip 52 extending therealong.

A knob 54 extends downwardly from the free, inner end of the shelf 46, into the aperture 44. The purpose of the slot 42, aperture 44, shelf 46, and knob 54 is to provide for the selective insertion of a transverse second pole 16*b* (for example) into the clip 20. This insertion can be made in either of two manners.

First, referring to FIG. 2, the transverse second pole 16*b* can be inserted downwardly through the slot 42 into the aperture 44. The second pole 16*b* is then pushed towards the left (as viewed in FIG. 2) and upwardly until it contacts the lower inner surface of the shelf 46. The first pole 16*a* is then inserted between the clasp portion 24 and wall 22, into the lower seat 30 of the clasp portion. When snapped into this position, the transverse second pole 16*b* is captured between the first pole 16*a* and the shelf 46 on the lower and upper sides of the second pole 16*b*, respectively, and between the knob 54 and left edge of the aperture 44 on the right and left sides. In this configuration, the pole 16*b* can slide freely through the clip 20 in a direction transverse to the longitudinal axis of the first pole 16*a*. However, the second pole 16*b* is substantially restrained from moving from side to side, i.e., along the direction of the longitudinal axis of the pole 16*a*, or up and down. The width of the aperture 44 between the knob 42 and the left edge of the aperture 44 is preferably greater than the diameter of the second pole 16*b*. This permits the second pole 16*b* to pivot relative to the first pole 16*b*, between orientations that are perpendicular to the first pole 16*a* or that define an obtuse or acute angle relative to the first pole 16*a*.

The second configuration is illustrated in FIG. 3. In this configuration, the second pole 16*b* is inserted through the slot 42 and depressed downwardly into the bottom of the aperture 44. The first pole 16*a* is then inserted between the clasp portion 24 and the wall 22, and is pressed upwardly into the upper seat 28. When so assembled, the second pole 16*b* is captured between the inner edges of the aperture 44 and the overlying first pole 16*a*. Again, the second pole 16*b*, can slide through the aperture 44 in a direction transverse to the longitudinal axis of the first pole 16*a*, but can move only a limited amount upwardly and downwardly or side to side within the aperture 44. The second pole 16*b* is able to pivot relative to the first pole 16*a* in a variety of transverse orientations.

Further detail of the construction of the clip 20 can be seen in FIGS. 4–8. Additional reinforcing lips 56 are defined along various edges of the clip 20. This is for strengthening and reinforcement of the clip 20, and may be altered or eliminated, depending on the physical properties of the material utilized to construct the clip 20. Additional apertures 58 may be provided through the wall 22 of the clip 24 for weight reduction.

The present invention thus provides a way to securely connect tent poles to tent fabric for enhanced structural rigidity. A single clip can accommodate crossed poles. It should be apparent that alterations could be made to the preferred embodiment in the invention disclosed herein, all within the scope of the present invention. For example, rather than providing first and second seats within the clasp portion of the clip, a single seat could be utilized. Furthermore, a clip 20 could be constructed without a slot 24 or aperture 44, which would accommodate only a single pole, while still utilizing the broad base and direct attachment of the present invention. Similarly, a clip 20 including the multi-seat locations for the first pole, or that accommodates first and second crossed poles could be incorporated into a clip that is secured by a fabric webbing or elastic cord to a tent fabric. Each of these would enjoy some, but not all the benefits of the preferred embodiment of the present invention. While a resilient material has been described as the preferred material for constructing the clip 20, a rigid material including a spring-biased clamp could be instead utilized, with sacrifice to weight and simplicity.

Thus while the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A fabric shelter comprising:

a fabric sheet defining a seam;

at least a first elongate pole for supporting the fabric sheet; and a clip defining a clasp portion for selective attachment to the first pole and a base secured directly to the fabric sheet at the seam, wherein the clasp portion defines a clasp length oriented along an axis of the first pole, the base defines a base length oriented parallel to the axis of the first pole, and the base length is longer than the clasp length.

2. The fabric shelter of claim 1, wherein the base of the clip defines a semi-rigid mesh through which stitching is passed to sew the base to the fabric sheet.

3. The fabric shelter of claim 1, wherein the clip is formed from a substantially rigid resilient material.

4. The fabric shelter of claim 1, wherein the clip is formed from a substantially rigid resilient material.

5. A fabric shelter comprising:

a fabric sheet;

at least a first elongate pole for supporting the fabric sheet; and a clip defining a clasp portion for selective attachment to the first pole and a base secured to the fabric sheet, wherein the clasp portion defines a clasp length oriented along an axis of the first pole, the base defines a base length oriented parallel to the axis of the first pole, and the base length is longer than the clasp length, wherein the clasp portion of the clip defines a first seat for receiving the first pole in an upper position and a parallel second seat for receiving the first pole in a lower position.

6. The fabric shelter of claim 5, further comprising a second elongate pole for supporting the fabric sheet, wherein the clip defines an aperture for receiving the second pole to couple the clip to the second pole with the second pole being oriented generally transversely relative to the first pole.

7. The fabric shelter of claim 6, wherein the second pole is received within the aperture below the first pole when the first pole is in the first seat and the second pole is received above the first pole when the first pole is in the second seat.

8. A fabric shelter comprising:

a fabric sheet;

at least a first elongate pole for supporting the fabric sheet; and a clip defining a clasp portion for selective attachment to the first pole and a base secured to the fabric sheet, wherein the clasp portion defines a clasp length oriented along an axis of the first pole, the base defines a base length oriented parallel to the axis of the first pole, and the base length is longer than the clasp length, further comprising a second pole for supporting the fabric sheet, wherein the clip defines an aperture for receiving the second pole to couple the second pole to the clip pole with the second pole being oriented generally transversely relative to the first pole.

9. The fabric shelter of claim 8, wherein the aperture is arranged to pivotally receive the second pole in an a variable generally transverse orientation with respect to the first pole.

10. The fabric shelter of claim 9, wherein the aperture is dimensioned such that the second pole is able to freely slide through the aperture.

11. A fabric shelter comprising:

a fabric sheet defining a seam;

at least a first elongate pole for supporting the fabric sheet; and a clip defining a clasp portion for selective attachment to the first pole and a base secured to the fabric sheet, wherein the base of the clip is formed from a substantially rigid resilient material and the base of the clip is secured directly to the fabric sheet at the seam.

12. The fabric shelter of claim 11, wherein the base of the clip is sewn within the seam.

13. A fabric shelter comprising:

a fabric sheet;

first and second elongate poles for supporting the fabric sheet; and a clip having a base secured to the fabric sheet, the clip defining first and second clasp portions extending from the base for selective attachment to the first pole and an aperture that bifurcates the first and second clasp portions, the aperture slidably receiving the second pole in a generally transverse orientation with respect to the first pole.

14. The fabric shelter of claim 13, wherein the clip is formed from a substantially rigid resilient material.

15. The fabric shelter of claim 13, wherein the clasp portion of the clip defines a first seat for receiving the first pole in an upper position and a parallel second seat for receiving the first pole in a lower position.

16. The fabric shelter of claim 15, further comprising a second pole for supporting the fabric sheet, wherein the clip defines an aperture for receiving the second pole to couple the clip to the second pole.

17. The fabric shelter of claim 15, wherein the second pole is received within the aperture below the first pole when the first pole is in the first seat, and the second pole is received within the aperture above the first pole when the first pole is in the second seat.

18. The fabric shelter of claim 13, wherein the aperture is arranged to pivotally receive the second pole in a variable generally transverse orientation with respect to the first pole.

19. The fabric shelter of claim 18, wherein the aperture is arranged to restrict movement of the first pole with respect to the first poles in two directions.

20. The fabric shelter of claim 19, wherein the aperture is dimensioned such that the second pole is able to freely slide through the aperture in a direction defined by a longitudinal axis of the second pole.

* * * * *

UNITED STATES PATENT AND TRADEMARK OFFICE

CERTIFICATE OF CORRECTION

PATENT NO. : 6,227,218 B1
DATED : May 8, 2001
INVENTOR(S) : T.J. Breaux

It is certified that error appears in the above-identified patent and that said Letters Patent is hereby corrected as shown below:

Title page,
Item [74], Attorney, Agent, or Firm, "Christiansen" should read -- Christensen --

Item [57] ABSTRACT, "receives a transverse" should read -- receive a transverse --

Column 6,
Line 2, "rigid resilient" should read -- rigid, resilient --
Line 4, "rigid resilient" should read -- rigid, resilient --

Signed and Sealed this

Eighth Day of January, 2002

*Attest:*

*Attesting Officer*

JAMES E. ROGAN
*Director of the United States Patent and Trademark Office*